US011643707B2

(12) United States Patent
Takahata

(10) Patent No.: US 11,643,707 B2
(45) Date of Patent: May 9, 2023

(54) CORROSION-RESISTANT CUZN ALLOY

(71) Applicant: JX Nippon Mining & Metals Corporation, Tokyo (JP)

(72) Inventor: Masahiro Takahata, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 0 days.

(21) Appl. No.: 17/288,398

(22) PCT Filed: Dec. 3, 2019

(86) PCT No.: PCT/JP2019/047271
§ 371 (c)(1),
(2) Date: Apr. 23, 2021

(87) PCT Pub. No.: WO2020/116464
PCT Pub. Date: Jun. 11, 2020

(65) Prior Publication Data

US 2021/0355563 A1 Nov. 18, 2021

(30) Foreign Application Priority Data

Dec. 3, 2018 (JP) ..... JP2018-226858

(51) Int. Cl.
*C22C 9/04* (2006.01)
*C22F 1/08* (2006.01)

(52) U.S. Cl.
CPC . *C22C 9/04* (2013.01); *C22F 1/08* (2013.01)

(58) Field of Classification Search
CPC ..... C22C 9/04; C22C 18/02; C22F 1/08
See application file for complete search history.

(56) References Cited

U.S. PATENT DOCUMENTS

| | | | |
|---|---|---|---|
| 4,226,621 | A | 10/1980 | Ruchel |
| 5,658,401 | A | 8/1997 | Gaag et al. |
| 2004/0165638 | A1 | 8/2004 | Morton et al. |
| 2005/0047471 | A1 | 3/2005 | Steiger et al. |
| 2013/0104349 | A1 | 5/2013 | Yoshimura et al. |
| 2013/0329763 | A1 | 12/2013 | Kardokus et al. |
| 2016/0289797 | A1 | 10/2016 | Kuhn et al. |
| 2017/0014928 | A1 | 1/2017 | Chang |

FOREIGN PATENT DOCUMENTS

| | | | |
|---|---|---|---|
| CN | 104350650 | A | 2/2015 |
| CN | 106191724 | A | 12/2016 |
| EP | 3524701 | A1 | 8/2019 |
| JP | 7116925 | A | 9/1995 |
| JP | 2000129376 | A | 5/2000 |

(Continued)

OTHER PUBLICATIONS

European Extended Search Report for EP Application No. 19893908.4 related to PCT/JP2019047271 dated Oct. 27, 2021, 8 pages.

(Continued)

*Primary Examiner* — Anthony M Liang
*Assistant Examiner* — Danny N Kang
(74) *Attorney, Agent, or Firm* — Faegre Drinker Biddle & Reath LLP

(57) ABSTRACT

Provided is a corrosion-resistant CuZn alloy, in which: the Zn content is 36.8 to 56.5 mass % and the balance is Cu and inevitable impurities; and the β-phase surface area percentage is 99.9% or greater.

4 Claims, 8 Drawing Sheets

(56) References Cited

FOREIGN PATENT DOCUMENTS

| | | | |
|---|---|---|---|
| JP | 2002363718 | A | 12/2002 |
| JP | 2003277856 | A | 10/2003 |
| JP | 3759633 | B2 | 3/2006 |
| JP | 2007500942 | A | 1/2007 |
| JP | 2007510284 | A | 4/2007 |
| JP | 2012062563 | A | 3/2012 |
| JP | 2013129876 | A | 7/2013 |
| JP | 2013209676 | A | 10/2013 |
| JP | 54047823 | B2 | 3/2014 |
| JP | 2015527726 | A | 9/2015 |
| JP | 5794906 | B2 | 10/2015 |
| KR | 20150016982 | A | 2/2015 |
| TW | 201202448 | A | 1/2012 |
| TW | 201641199 | A | 12/2016 |
| WO | 2013184387 | A1 | 12/2013 |
| WO | 2015191297 | A1 | 12/2015 |
| WO | 2019097846 | A1 | 5/2019 |

OTHER PUBLICATIONS

Taiwan Office Action for corresponding Taiwan Patent Application No. 11020266330, dated Mar. 23, 2020, 4 pages (including English translation).

TW Office Action for corresponding Application No. TW108144139 dated Aug. 13, 2020, 4 pages.

JP International Search Report and Written Opinion for PCT/JP2019/047271 dated Mar. 10, 2020, 5 pages.

JP International Preliminary Examination Report for PCT/JP2019/047271 dated Aug. 18, 2020, 4 pages.

JP ISA for PCT/JP2019/047271 dated Feb. 26, 2020, 10 pages.

"Non-ferrous casting alloys and smelting", dated Nov. 23, 2021 with English machine translation, pp. 122-123.

Chinese Office Action from the corresponding Chinese Patent Application No. 201980075491.7 dated Dec. 2, 2021, 14 pages (with English translation).

JP Office Action for corresponding JP Patent Application No. JP2020-559236 dated Sep. 14, 2022, 10 pages, with English translation.

Second China Office Action for the corresponding Chinese Patent Application No. 201980075491.7 dated Jun. 2, 2022, 10 pages (including machine translation).

Korean Office Action for corresponding Korean Application No. 10-2021-7014266 dated Oct. 19, 2022, 9 pages.

Taiwan Office Action for corresponding Taiwan Application No. TW108144139 dated Oct. 19, 2022, 10 pages.

CNIPA Office Action for corresponding Chinese Patent Application No. 201980075491.7 dated Jan. 19, 2023, 14 pages with translation.

"Copper and Copper Alloys", cited in CNIPA Office Action as Public Evidence 2, downloaded on Dec. 23, 2022 from https://book.duxiu.com/bookDetail jsp?dxNumber=000004054436&d=071C5148D8823942075AE538B1ACFE7.

CORROSION-RESISTANT CUZN ALLOY

FIELD OF THE INVENTION

The present invention relates to a corrosion-resistant CuZn alloy that can be suitably used for electrodes employed in an acidic atmosphere.

BACKGROUND OF THE INVENTION

Recently, pulsed laser light has been used for integrated circuit photolithography. The pulsed laser light can be generated by applying gas discharge between a pair of electrodes at very short electric discharge and at very high voltage in a gas discharge medium. For example, in ArF laser systems, fluorine-containing plasma is generated between the pair of electrodes during operation. The fluorine-containing plasma is highly corrosive to metals. As a result, the electrodes corrode over time during operation of a pulsed laser generator. The corrosion of the electrodes forms a corrosion spot, which causes arcing in the plasma, thereby further accelerating shortening of the lifetime of the electrode. For the electrodes, for example, a Cu-containing alloy is used.

As a technique for prolonging the lifetime of the electrode, a technique for stably using an electrode for a long period of time have been developed (Patent Literatures 1 and 2), in which a body portion of a discharging electrode made of a Cu-containing alloy is partially exposed (a discharge receiving area) for discharge and other portions are covered with the other alloy. On the other hand, in addition to such improvement of the structure of the electrode, Patent Literature 3 discloses a technique for prolonging the lifetime of the electrode by using phosphorus-doped brass as a copper alloy used for the electrode to reduce generation of micro pores in the brass.

CITATION LIST

Patent Literatures

[Patent Literature 1] Japanese Patent Application Publication No. 2007-500942 A

[Patent Literature 2] Japanese Patent Application Publication No. 2007-510284 A

[Patent Literature 3] Japanese Patent Application Publication No. 2015-527726 A

SUMMARY OF THE INVENTION

Technical Problem

Even in the prior arts attempting to prolong the lifetime of the electrode by improving the structure of the electrode, the lifetime of the electrode can be further prolonged if corrosion resistance of the Cu-containing alloy is improved. Further, in the technique for prolonging the lifetime by using phosphorus-doped brass, a burden to an increase in the number of steps is caused due to a step of doping the Cu-containing alloy with phosphorus to a target concentration. It is preferable that such a burden can be avoided.

Thus, an object of the present invention is to provide a Cu-containing alloy having improved corrosion resistance.

Solution to Problem

As a result of intensive studies, the present inventors have found that a CuZn alloy having a composition as described below is subjected to a multistage forging process, thereby exerting improved corrosion resistance without adding other elements, and they have arrived at the present invention.

Thus, the present invention includes the following aspect (1):

(1)

A corrosion-resistant CuZn alloy, the CuZn alloy having a Zn content of from 36.8 to 56.5% by mass, the balance being Cu and inevitable impurities, wherein the CuZn alloy has an area ratio of 8 phases of 99.9% or more.

Advantageous Effects of Invention

According to the present invention, a corrosion-resistant CuZn alloy is obtained. The corrosion-resistant CuZn alloy according to the present invention can be suitably used for electrodes employed in an acidic atmosphere, and is particularly suitable for electrodes of ArF laser systems and KrF laser systems. The corrosion-resistant CuZn alloy according to the present invention does not require the addition of other elements during the production and can be produced while avoiding the burden to an increase in the number of steps involved by those addition steps.

BRIEF DESCRIPTION OF THE DRAWINGS

FIG. 2-1 shows results of a corrosion resistance test using nitric acid for Samples 1 to 3;

FIG. 2-2 shows results of a corrosion resistance test using nitric acid for samples 4 to 6;

FIG. 3-1 shows results of a corrosion resistance test using an aqueous nitrohydrofluoric acid solution for Samples 1 to 3;

FIG. 3-2 shows results of a corrosion resistance test using an aqueous nitrohydrofluoric acid solution for Samples 4 to 6;

DETAILED DESCRIPTION OF THE INVENTION

Figure 1:
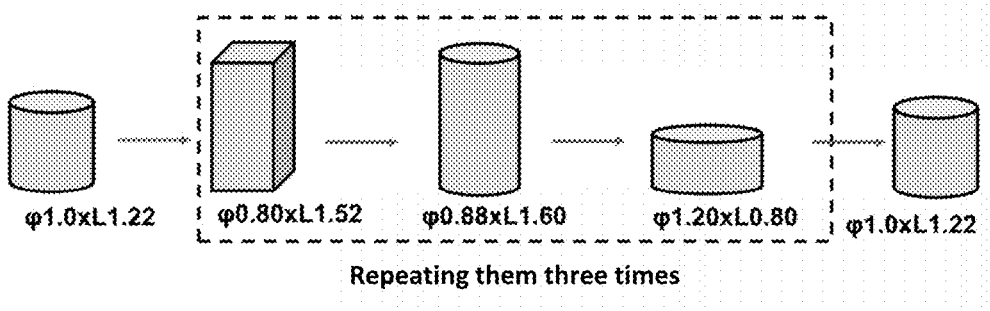
FIG. 1 is an explanatory view of a procedure in Production Example 1.

Hereinafter, the present invention will be described in detail by way of embodiments. The present invention is not limited to the specific embodiments as described below.

[Corrosion-Resistance CuZn Alloy]

A corrosion-resistant CuZn alloy according to the present invention is a CuZn alloy having a Zn content of from 36.8 to 56.5% by mass, the balance being Cu and inevitable impurities, wherein the alloy has an area ratio of β phases of 99.9% or more. The CuZn alloy can be suitably used as an alloy for corrosion-resistant electrodes.

[Zn Content and Cu Content]

The Zn content can be from 36.8 to 56.5% by mass, for example, preferably from 36.5 to 50.0% by mass, and more preferably from 36.5 to 46.0% by mass, or preferably from 36.8 to 50.0% by mass, and more preferably from 36.8 to 46.0% by mass, or from 40.0 to 46.0% by mass. The total of the Zn content and the Cu content can be 99.999% by mass or more, and preferably 99.9999% by mass or more, and more preferably 99.99995% by mass or more.

[Inevitable Impurities]

In the present invention, the CuZn alloy may further contain inevitable impurities in the following content of each element:

a Na content of less than 0.05 ppm, and preferably less than 0.01 ppm (less than measurement limit);

a Mg content of less than 0.01 ppm, and preferably less than 0.001 ppm (less than the measurement limit);

an Al content of less than 0.01 ppm, and preferably less than 0.001 ppm (less than the measurement limit);

a Si content of less than 0.5 ppm, and preferably less than 0.005 ppm (less than the measurement limit);

a P content of less than 0.01 ppm, and preferably less than 0.005 ppm (less than the measurement limit);

a S content of 0.05 ppm or less, and preferably less than 0.05 ppm (less than the measurement limit);

a Cl content of less than 0.05 ppm, and preferably less than 0.005 ppm (less than the measurement limit);

a K content of 0.01 ppm or less, and preferably less than 0.01 ppm (less than the measurement limit);

a V content of less than 0.1 ppm, and preferably less than 0.001 ppm (less than the measurement limit);

a Cr content of less than 1 ppm, and preferably 0.09 ppm or less;

a Mn content of less than 0.5 ppm, and preferably 0.3 ppm or less;

a Fe content of less than 1 ppm, and preferably 0.8 ppm or less;

a Ni content of less than 5 ppm, and preferably 0.2 ppm or less;

a Ga content of less than 0.1 ppm, and preferably less than 0.05 ppm (less than the measurement limit);

an As content of less than 0.05 ppm, and preferably less than 0.005 ppm (less than the measurement limit);

a Se content of less than 0.1 ppm, and preferably 0.04 ppm or less;

a Mo content of less than 0.5 ppm, and preferably less than 0.005 ppm (less than the measurement limit);

a Ag content of less than 0.5 ppm, and preferably 0.15 ppm or less;

a Cd content of less than 0.5 ppm, and preferably 0.05 ppm or less;

a Sn content of less than 0.1 ppm, and preferably less than 0.005 ppm (less than the measurement limit);

an Sb content of less than 0.01 ppm, and preferably less than 0.005 ppm (less than the measurement limit);

a Ba content of less than 0.01 ppm, and preferably less than 0.005 ppm (less than the measurement limit);

a Pb content of less than 5 ppm, and preferably 3 ppm or less;

a Bi content of 0.01 ppm or less, or less than 0.01 ppm, and preferably less than 0.001 ppm (less than the measurement limit); and an O content of less than 10 ppm, and preferably less than 1 ppm (less than the measurement limit).

In a preferred embodiment, the contents of the impurity elements can be equal to or less than the values of the contents of the respective elements in the sample 1 as shown in Table 1 (Table 1-1, Table 1-2, Table 1-3) described later. For each element that is less than the measurement limit in sample 1, its content can be less than the measurement limit.

The metal elements can be analyzed by GD-MS (VG-9000 from VG Scientific), and the gas components can be analyzed using LECO oxygen/nitrogen analyzer (model TCH-600) for oxygen (O), nitrogen (N) and hydrogen (H), and using LECO carbon/sulfur analyzer (model CS-444) for carbon (C) and sulfur (S).

[Area Ratio of β Phases]

In a preferred embodiment, the corrosion-resistant CuZn alloy according to the present invention has area ratio of β-phases of, for example, 99.9% or more, and preferably 99.99% or more, and more preferably 99.999% or more. The upper limit of the area ratio of the β phases is not particularly limited, but it can be, for example, 100% or less.

The area ratio of the β phases can be calculated by the means as described later in Examples.

It is known that in the CuZn alloy, a phases, β phases, and γ phases appear in the range and temperature of the Zn content according to the present invention. In a preferred embodiment, the corrosion-resistant CuZn alloy according to the present invention has the area ratio of the β-phases in the above range, and as a result, the total of the area ratios of the α-phase and the γ-phases can be, for example, 0.01% or less, and preferably 0.001% or less, and more preferably 0.0001% or less. The lower limit of the total of the area ratios of the α phases and the γ phases is not particularly limited, but it can be, for example, 0% or more.

[Average Crystal Grain Size]

In a preferred embodiment, the corrosion-resistant CuZn alloy according to the present invention may have an average crystal grain size D50, for example, in a range of from 0.3 to 0.6 mm, and preferably from 0.4 to 0.6 mm, and more preferably from 0.45 to 0.55 mm, for example in a range of from 0.3 to 0.7 mm, and preferably from 0.4 to 0.65 mm, and more preferably from 0.45 to 0.65 mm. In a preferred embodiment, the corrosion-resistant CuZn alloy according to the present invention may have an average crystal grain size D90, for example, in a range of from 0.3 to 0.7 mm, and preferably from 0.5 to 0.7 mm, and more preferably from 0.55 to 0.65 mm, for example in a range of from 0.3 to 0.8 mm, and preferably from 0.5 to 0.75 mm, and more preferably from 0.55 to 0.75 mm.

[Corrosion Resistance]

The corrosion-resistant CuZn alloy according to the present invention has improved corrosion resistance in a fluorine-containing environment. The corrosion resistance in the present invention can be tested by a nitrohydrofluoric acid test described in Examples as severe conditions.

[Production of Corrosion-Resistant CuZn Alloy]

In a preferred embodiment, the corrosion-resistant CuZn alloy according to the present invention can be produced by the means and conditions disclosed in Examples as described later.

That is, in a preferred embodiment, the corrosion-resistant CuZn alloy can be produced by a method including: a step of melting a Cu raw material and a Zn raw material in vacuum, and maintaining the molten material in an inert gas atmosphere while heating it to obtain a high-purity CuZn alloy; a step of subjecting the obtained high-purity CuZn alloy to a multistage forging process; and a step of forging the high-purity CuZn alloy subjected to the multiple stage forging process to have a predetermined shape.

The multistage forging process can be carried out by the means and conditions disclosed in Examples as described later. That is, in a preferred embodiment, for example, the multistage forging process can be carried out by repeating the following procedure three times or more: a cylindrical ingot having an aspect ratio of 1:1.22 is preheated at a temperature of from 550 to 680° C. for 3 hours or more to deform the shape of the ingot into a prismatic shape having an aspect ratio of 0.8:1.52, a cylindrical shape having an aspect ratio of 0.88:1.6, and a cylindrical shape having an aspect ratio of 1.2:0.8, and deform it into the original cylindrical shape having an aspect ratio of 1:1.22, and it was reheated at a temperature of from 550 to 680° C. for 10 minutes or more.

[Alloy for Corrosion-Resistant Electrode]

The corrosion-resistant CuZn alloy according to the present invention has improved corrosion resistance in a fluorine-containing environment, so that it can be suitably used as an alloy for corrosion-resistant electrodes. The corrosion-resistant CuZn alloy according to the present invention exerts improved corrosion resistance while avoiding secondary impurity contamination caused by doping for adding other elements, so that it can be used as a high-purity electrode material. The corrosion-resistant CuZn alloy according to the present invention can form an electrode having improved corrosion resistance by using a technique for improving corrosion resistance based on improvement of the electrode structure of the prior art.

Preferable Embodiments

As preferable embodiments, the present invention includes the following aspects (1) to (6):

(1)

A corrosion-resistant CuZn alloy, the CuZn alloy having a Zn content of from 36.8 to 56.5% by mass, the balance being Cu and inevitable impurities, wherein the CuZn alloy has an area ratio of β phases of 99.9% or more.

(2)

The CuZn alloy according to (1), wherein the total content of Zn and Cu is 99.999% by mass or more.

(3)

The CuZn alloy according to (1) or (2), wherein the CuZn alloy has an average crystal grain size D50 in a range of from 0.3 to 0.6 mm.

(4)

The CuZn alloy according to any one of (1) to (3), wherein the CuZn alloy has a total area ratio of a phases and γ phases of 0.01% or less.

(5)

The CuZn alloy according to any one of (1) to (4), wherein the CuZn alloy is an alloy for corrosion-resistant electrodes.

(6)

The CuZn alloy according to any one of (1) to (5), wherein the CuZn alloy has a Na content of less than 0.05 ppm, a Mg content of less than 0.01 ppm, an Al content of less than 0.01 ppm, a Si content of less than 0.5 ppm, a P content of less than 0.01 ppm, a S content of less than 0.05 ppm, a Cl content of less than 0.05 ppm, a K content of less than 0.01 ppm, a V content of less than 0.1 ppm, a Cr content of less than 1 ppm, a Mn content of less than 0.5 ppm, a Fe content of less than 1 ppm, a Ni content of less than 5 ppm, a Ga content of less than 0.1 ppm, an As content of less than 0.05 ppm, a Se content of less than 0.1 ppm, a Mo content of less than 0.5 ppm, a Ag content of less than 0.5 ppm, a Cd content of less than 0.5 ppm, a Sn content of less than 0.1 ppm, an Sb content of less than 0.01 ppm, a Ba content of less than 0.01 ppm, a Pb content of less than 5 ppm, a Bi content of less than 0.01 ppm, and an O content of less than 10 ppm.

EXAMPLES

Hereinafter, the present invention will be described with reference to Examples. The present invention is not limited to the following Examples. Other examples and variations within the spirit of the present invention are included in the present invention.

Production Example 1 Example: Sample 1

A CuZn alloy was produced as follows:

The following Cu raw material and Zn raw material were prepared as raw materials:

Cu raw material: high-purity metal copper (6N) (a purity of 99.9999%); and

Zn raw material: high-purity metal zinc (4N5) (a purity of 99.995%).

11.45 kg of the Cu raw material and 10.05 kg of the Zn raw material were subjected to vacuum melting (conditions: vacuum-drawn to $10^{-1}$ Pa, and then maintained in 400 torr Ar atmosphere at 1050° C. for 30 minutes) to obtain a high-purity CuZn alloy. An ingot pipping portion at an upper portion of the ingot was removed from the resulting CuZn alloy to obtain a cylindrical ingot (a cylindrical ingot before multistage forging) having a diameter φ of 125 mm, a length of 152.5 mm, and a weight of 15 kg.

The obtained cylindrical ingot before multistage forging was subjected to the multistage forging process. The forging was carried out by repeating the following procedure three times: a cylindrical ingot having an aspect ratio of 1:1.22 was preheated at a temperature of from 550 to 680° C. for 3 hours or more to deform it into a prismatic shape having an aspect ratio of 0.8:1.52, a cylindrical shape having an aspect ratio 0.88:1.6, and a cylindrical shape having an aspect ratio of 1.2:0.8, and then deform it into the original cylindrical shape having an aspect ratio of 1:1.22, and it was reheated at a temperature of from 550 to 680° C. for 10 minutes or more. A cylindrical ingot (a cylindrical ingot after multistage forging) having a diameter of 125 mm, a length of 152.5 mm, and a weight of 15 kg was thus obtained.

The obtained cylindrical ingot after multistage forging was forged to φ 41 mm and then cut at a length of 650 mm to obtain two forged rods.

The obtained forged rod was used for the subsequent test as Sample 1.

FIG. 1 shows an explanatory view of the procedure in Production Example 1. In FIG. 1, the left end shows the cylindrical ingot having a diameter of 125 mm and a length of 152.5 mm, and each length in FIG. 1 is described by a relative value where 125 mm is 1, for comparison.

Production Example 2 Comparative Example: Sample 2

The Cu raw material and the Zn raw material were prepared, and a cylindrical ingot (a cylindrical ingot before multistage forging) having a diameter of 125 mm, a length of 152.5 mm, and a weight of 15 kg was obtained, in the same procedure as that of Production Example 1. The cylindrical ingot before multistage forging was forged to φ 41 mm without carrying out the multistage forging process according to Production Example 1, and then cut at a length of 650 mm to obtain two forged rods.

The obtained forged rod was used for the subsequent test as Sample 2.

Production Example 3 Comparative Example: Sample 3

A commercially available CuZn alloy (from JX Nippon Mining & Metals Corporation) was forged to φ 41 mm as it was without carrying out the multistage forging process according to Production Example 1, and then cut at a length of 650 mm to obtain two forged rods.

The obtained forged rod was used for the subsequent test as Sample 3.

Production Example 4 Example: Sample 4

The same Cu raw material and Zn raw material as those used in Production Example 1 were used in 10.80 kg of the Cu raw material and 10.45 kg of Zn raw material to obtain a cylindrical ingot (a cylindrical ingot before multistage forging) having a diameter of 124 mm, a length of 150.0 mm, and a weight of 15.15 kg in the same procedure as that of Production Example 1.

The obtained cylindrical ingot before multistage forging was subjected to a multistage forging process in the same procedure as that of Production Example 1 to obtain a cylindrical ingot (a cylindrical ingot after multistage forging) having a diameter of 124 mm, a length of 150 mm, and a weight of 15.15 kg.

The obtained cylindrical ingot after multistage forging was forged to φ 41 mm and then cut a length of 650 mm to obtain two forged rods.

The obtained forged rod was used for the subsequent test as Sample 4.

Production Example 5 Example: Sample 5

The same Cu raw material and Zn raw material as those used in Production Example 1 were used in 10.14 kg of the Cu raw material and 10.85 kg of the Zn raw material to obtain a cylindrical ingot (a cylindrical ingot before multistage forging) having a diameter of 124 mm, a length of 148.0 mm, and a weight of 14.9 kg in the same procedure as that of Production Example 1.

The obtained cylindrical ingot before multistage forging was subjected to a multistage forging process in the same procedure as that of Production Example 1 to obtain a cylindrical ingot (a cylindrical ingot after multistage forging) having a diameter of 124 mm, a length of 148.0 mm, and a weight of 14.9 kg.

The obtained cylindrical ingot after multistage forging was forged to φ 41 mm and then cut at a length of 650 mm to obtain two forged rods.

The obtained forged rod was used for the subsequent test as Sample 5.

Production Example 6 Example: Sample 6

The same Cu raw material and Zn raw material as those used in Production Example 1 were used in 156 kg of the Cu raw material and 137 kg of the Zn raw material to obtain a cylindrical ingot having a diameter of 225 mm, a length of 870 mm, and a weight of 292 kg (a cylindrical ingot before multistage forging) in the same procedure as that of Production Example 1. The composition of the Zn raw material is calculated to have 46.67% by weight. The ingot was cut in half in the longitudinal direction to have a diameter of 225 mm and a length of 435 mm, and forged to a diameter of 124 mm and a length of 1432 mm by ordinary hot forging. The ingot was then cut in the length direction into nine equal parts to obtain an ingot before multistage forging, which had a diameter of 125 mm and a length of 152 mm.

The cylindrical ingot before multistage forging obtained above was subjected to the multistage forging process as in each of Samples 1, 2, 4, 5, and 6. A cylindrical ingot (a cylindrical ingot after multistage forging) having a diameter of 125 mm, a length of 152 mm, and a weight of 15.33 kg was then obtained.

The obtained cylindrical ingot after multistage forging was forged to φ 41 mm and then cut at a length of 650 mm to obtain two forged rods.

The obtained forged rod was used for the subsequent test as Sample 6.

[Composition Analysis]

For the compositions of Samples 1 to 6, the metal elements were analyzed by GD-MS (VG 9000 available from VG Scientific), and the gas components were analyzed by an oxygen/nitrogen analyzer (Model TCH-600) available from LECO for oxygen (O), nitrogen (N) and hydrogen (H), and analyzed by a carbon/sulfur analyzer (Model CS-444) available from LECO for carbon (C) and sulfur (S). The results obtained are shown in Table 1 (Table 1-1, Table 1-2, and Table 1-3) as described below. The numerical values represented by signs of inequality indicate that those value ware below the measurement limit. In Table 1 (Table 1-1, Table 1-2 and Table 1-3), the unit for the numerical values with no specific description means wtppm (ppm by mass).

TABLE 1-1

| | Sample 1 | Sample 2 | Sample 3 | Sample 4 | Sample 5 | Sample 6 |
|---|---|---|---|---|---|---|
| Li | <0.001 | <0.001 | <0.001 | <0.001 | <0.001 | <0.001 |
| Be | <0.001 | <0.001 | 0.06 | <0.001 | <0.001 | <0.001 |
| B | <0.001 | <0.001 | 0.84 | <0.001 | <0.001 | <0.001 |
| F | <0.01 | <0.01 | <0.01 | <0.01 | <0.01 | <0.01 |
| Na | <0.01 | <0.01 | <0.01 | <0.01 | <0.01 | <0.01 |
| Mg | <0.001 | <0.001 | 24 | <0.001 | <0.001 | <0.001 |
| Al | <0.001 | <0.001 | 0.14 wt % | <0.001 | <0.001 | <0.001 |
| Si | <0.005 | <0.005 | 25 | <0.005 | <0.005 | <0.005 |
| P | <0.005 | <0.005 | 31 | 0.01 | <0.005 | 0.014 |
| S | <0.05 | <0.05 | 3.1 | <0.05 | <0.05 | <0.05 |
| Cl | <0.005 | <0.005 | <0.005 | <0.005 | <0.005 | <0.005 |
| K | <0.01 | <0.01 | <0.01 | <0.01 | <0.01 | <0.01 |
| Ca | <0.005 | <0.005 | <0.005 | <0.005 | <0.005 | <0.005 |
| Sc | <0.001 | <0.001 | <0.001 | <0.001 | <0.001 | <0.001 |
| Ti | <0.001 | <0.001 | 0.35 | <0.001 | <0.001 | <0.001 |
| V | <0.001 | <0.001 | 0.11 | <0.001 | <0.001 | <0.001 |
| Cr | 0.082 | 0.082 | 29 | 0.044 | 0.12 | 0.053 |
| Mn | 0.3 | 0.02 | 17 | 0.059 | 0.08 | 0.059 |
| Fe | 0.71 | 0.84 | 380 | 0.88 | 0.94 | 0.98 |
| Co | 0.14 | 0.11 | 2.4 | 0.005 | 0.87 | 0.005 |
| Ni | 0.16 | 0.12 | 310 | 0.079 | 0.5 | 0.079 |
| Cu | — | — | — | — | — | — |
| Zn | 45.4 wt % | 45.4 wt % | 45.0 wt % | 48.3 wt % | 49.9 wt % | 45.1 wt % |
| Ga | <0.05 | <0.05 | 0.99 | <0.05 | <0.05 | <0.05 |
| Ge | <0.1 | <0.1 | 3.1 | <0.1 | <0.1 | <0.1 |
| As | <0.005 | <0.005 | 1.1 | <0.005 | <0.005 | <0.005 |

TABLE 1-2

| | | | | | | |
|---|---|---|---|---|---|---|
| Se | 0.04 | <0.01 | 0.28 | <0.01 | 0.04 | <0.01 |
| Br | <0.05 | <0.05 | <0.05 | <0.05 | <0.05 | <0.05 |
| Rb | <0.001 | <0.001 | <0.001 | <0.001 | <0.001 | <0.001 |
| Sr | <0.001 | <0.001 | <0.001 | <0.001 | <0.001 | <0.001 |
| Y | <0.001 | <0.001 | 0.01 | <0.001 | <0.001 | <0.001 |
| Zr | <0.001 | <0.001 | 5.7 | <0.001 | <0.001 | <0.001 |
| Nb | <0.005 | <0.005 | 2 | <0.005 | <0.005 | <0.005 |
| Mo | <0.005 | <0.005 | 0.4 | <0.005 | 0.007 | <0.005 |
| Ru | <0.1 | <0.1 | <0.1 | <0.1 | <0.1 | <0.1 |
| Rh | <1 | <1 | <1 | <1 | <1 | <1 |
| Pd | <0.5 | <0.5 | <0.5 | <0.5 | <0.5 | <0.5 |
| Ag | 0.11 | 0.16 | 21 | 1.1 | 0.87 | 0.9 |
| Cd | 0.05 | 0.07 | 8 | 0.06 | <0.01 | 0.08 |
| In | <0.05 | <0.05 | 6 | <0.05 | <0.05 | <0.05 |
| Sn | <0.005 | <0.005 | 0.11 wt % | <0.005 | <0.005 | <0.005 |

TABLE 1-2-continued

| | | | | | | |
|---|---|---|---|---|---|---|
| Sb | <0.005 | <0.005 | 49 | <0.005 | <0.005 | <0.005 |
| Te | <0.05 | <0.05 | 0.37 | <0.05 | <0.05 | <0.05 |
| I | <0.1 | <0.1 | <0.1 | <0.1 | <0.1 | <0.1 |
| Cs | <0.05 | <0.05 | <0.05 | <0.05 | <0.05 | <0.05 |
| Ba | <0.005 | <0.005 | <0.005 | <0.005 | <0.005 | <0.005 |
| La | <0.001 | <0.001 | <0.001 | <0.001 | <0.001 | <0.001 |
| Ce | <0.001 | <0.001 | <0.001 | <0.001 | <0.001 | <0.001 |
| Pr | <0.001 | <0.001 | <0.001 | <0.001 | <0.001 | <0.001 |
| Nd | <0.05 | <0.05 | <0.05 | <0.05 | <0.05 | <0.05 |
| Sm | <0.005 | <0.005 | <0.005 | <0.005 | <0.005 | <0.005 |
| Eu | <0.001 | <0.001 | <0.001 | <0.001 | <0.001 | <0.001 |
| Gd | <0.001 | <0.001 | <0.001 | <0.001 | <0.001 | <0.001 |

TABLE 1-3

| | | | | | | |
|---|---|---|---|---|---|---|
| Tb | <0.001 | <0.001 | <0.001 | <0.001 | <0.001 | <0.001 |
| Dy | <0.001 | <0.001 | <0.001 | <0.001 | <0.001 | <0.001 |
| Ho | <0.001 | <0.001 | <0.001 | <0.001 | <0.001 | <0.001 |
| Er | <0.005 | <0.005 | <0.005 | <0.005 | <0.005 | <0.005 |
| Tm | <0.005 | <0.005 | <0.005 | <0.005 | <0.005 | <0.005 |
| Yb | <0.001 | <0.001 | <0.001 | <0.001 | <0.001 | <0.001 |
| Lu | <0.001 | <0.001 | <0.001 | <0.001 | <0.001 | <0.001 |
| Hf | <0.001 | <0.001 | <0.001 | <0.001 | <0.001 | <0.001 |
| Ta | <1 | <1 | <1 | <1 | <1 | <1 |
| W | <0.005 | <0.005 | <0.005 | <0.005 | <0.005 | <0.005 |
| Re | <0.005 | <0.005 | <0.005 | <0.005 | <0.005 | <0.005 |
| Os | <0.001 | <0.001 | <0.001 | <0.001 | <0.001 | <0.001 |
| Jr | <0.005 | <0.005 | <0.005 | <0.005 | <0.005 | <0.005 |
| Pt | <0.05 | <0.05 | <0.05 | <0.05 | <0.05 | <0.05 |
| Au | <0.1 | <0.1 | <0.1 | <0.1 | <0.1 | <0.1 |
| Hg | <0.01 | <0.01 | <0.01 | <0.01 | <0.01 | <0.01 |
| Tl | 0.57 | 0.57 | 1.8 | 0.78 | 0.65 | 0.78 |
| Pb | 3 | 3.1 | 2.4 wt % | 3.7 | 5.1 | 3.6 |
| Bi | <0.001 | <0.001 | 15 | <0.001 | <0.001 | <0.001 |
| Th | <0.001 | <0.001 | <0.001 | <0.001 | <0.001 | <0.001 |
| U | <0.001 | <0.001 | <0.001 | <0.001 | <0.001 | <0.001 |
| C | <1 | <1 | 30 | <1 | <1 | <1 |
| N | <1 | <1 | 8 | <1 | <1 | <1 |
| O | <1 | <1 | 6 | <1 | <1 | <1 |
| H | <1 | <1 | 8 | <1 | <1 | <1 |

[Corrosion Resistance Test]

[Nitric Acid Test]

Figures 1, 2:
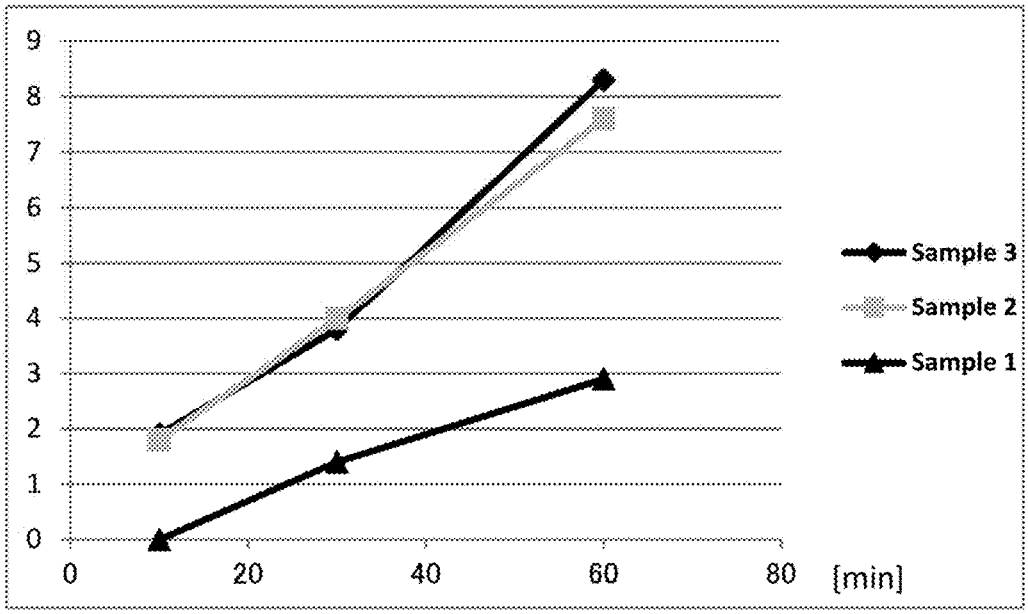
Figure 2:
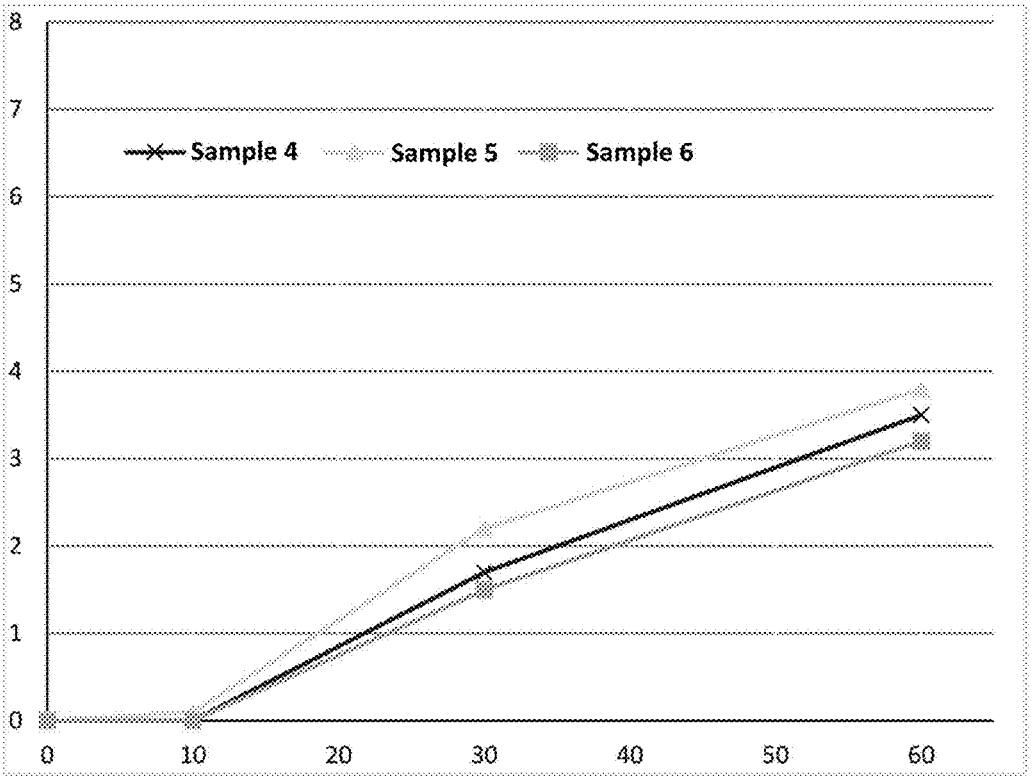

The corrosion resistance test using nitric acid was carried out in the following procedure:

8.3 g of each of Samples 1 to 6 (each size: 10 mm×10 mm×10 mm) was prepared. An aqueous nitric acid solution was prepared by mixing 80 ml of nitric acid (65%) with 420 ml of pure water. Each of Samples 1 to 6 was added to 500 ml of the aqueous nitric acid solution, and measured for weight loss after 10 minutes, 30 minutes and 60 minutes of the addition, with stirring at 25° C., to calculate a dissolved amount (mg/cm$^2$) for each of the above times. The results of the corrosion resistance test using nitric acid are shown in FIG. 2 (FIG. 2-1 and FIG. 2-2). The horizontal axis of FIG. 2 (FIG. 2-1 and FIG. 2-2) represents a leaching time (min), and the vertical axis represents a dissolved amount (mg/cm$^2$).

[Nitrohydrofluoric Acid Test]

Figures 1, 3:
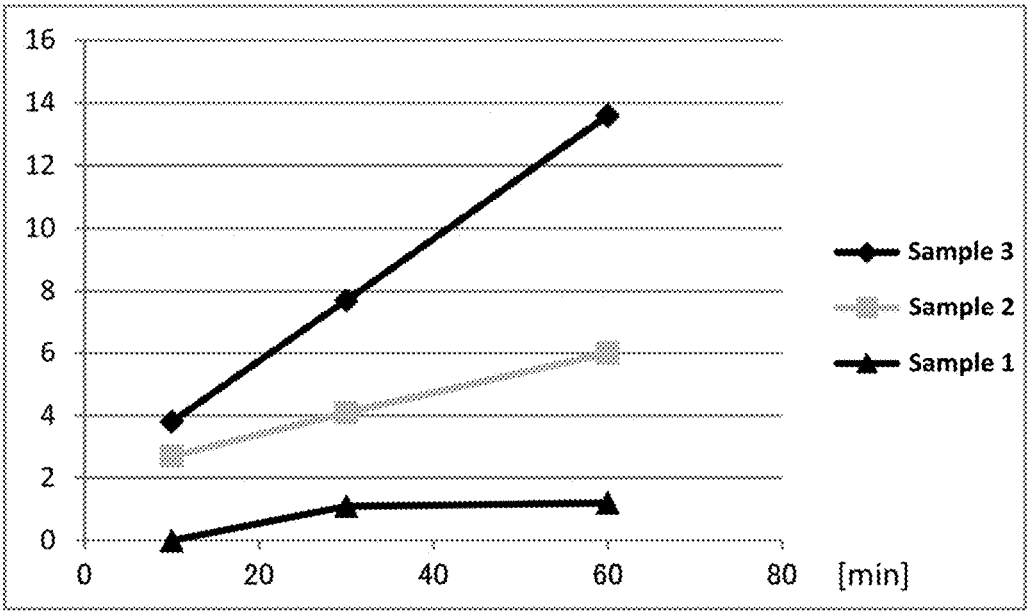
Figures 2, 3:
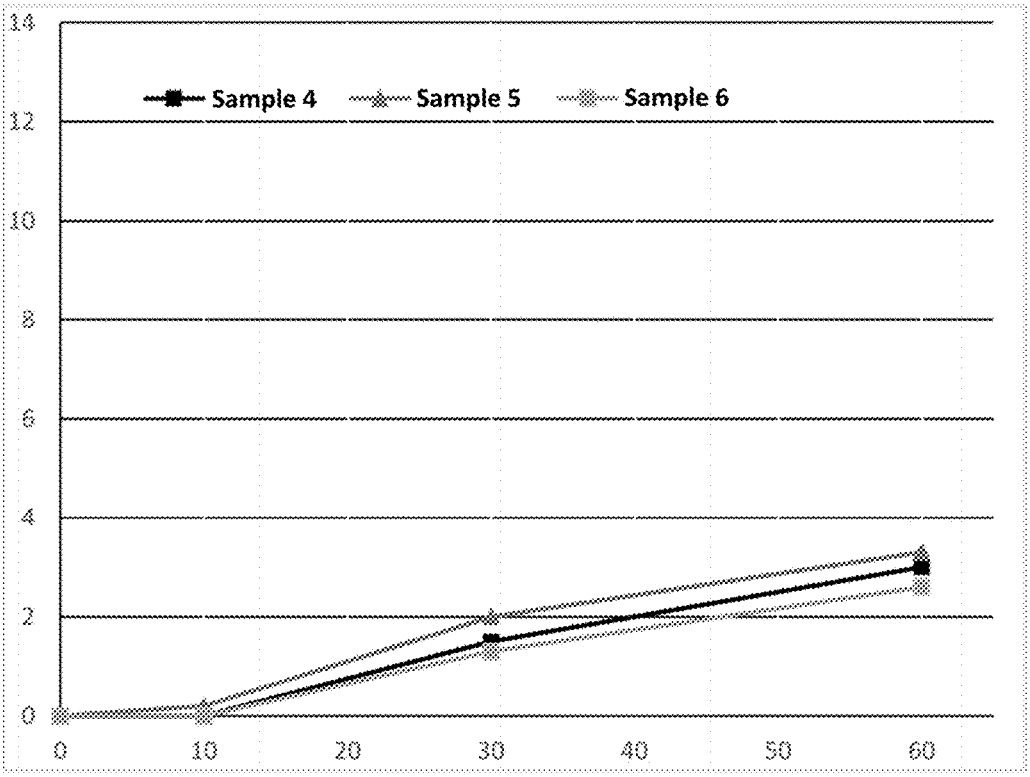

The corrosion resistance test using nitrohydrofluoric acid was carried out in the following procedure:

8.3 g of each of samples 1 to 6 (each size: 10 mm×10 mm×10 mm) was prepared. An aqueous nitrohydrofluoric acid solution was prepared by mixing 20 ml of hydrofluoric acid (46%), 60 ml of nitric acid (65%) and 420 ml of pure water. Each of samples 1 to 6 was added to 500 ml of the aqueous nitrohydrofluoric acid solution, and measured for weight loss after 10 minutes, 30 minutes and 60 minutes of the addition, with stirring at 25° C., to calculate a dissolved amount (mg/cm$^2$) for each of the above times. The results of the corrosion resistance test using the aqueous nitrohydrofluoric acid solution are shown in FIG. 3 (FIG. 3-1 and FIG. 3-2). The horizontal axis of FIG. 3 (FIG. 3-1 and FIG. 3-2) represents a leaching time (min), and the vertical axis represents a dissolved amount (mg/cm$^2$).

[Study for Uniformity of Structure]

In order to study the uniformity of the structures, about 300 photographs of the cross section of the forged rod were taken for each of Samples 1 to 6, and the particle size distributions were obtained by image analysis. Graphs were created for Sample 1 and Sample 3, among the above samples. For the image analysis, the X-ray diffraction revealed that color tones of the obtained photographs were divided into 256 stages, and thresholds 0 to 64 were the α phases, thresholds 65 to 168 were the β phases, and thresholds 168 to 255 were the γ phases, and statistical processing was then carried out. These image analysis processes were performed by own software. For the thresholds, six types of standard samples from the Zn content of 35% by mass to 60% by mass for every 5% by mass, and five for each type, were prepared, and phases at measurement points were identified by X-ray diffraction using an automated multipurpose X-ray diffractometer SmartLab from Rigaku, and the uniformity of the structures was determined from the color tones of the optical microscope photographs at the X-ray diffraction sites.

Figure 4:
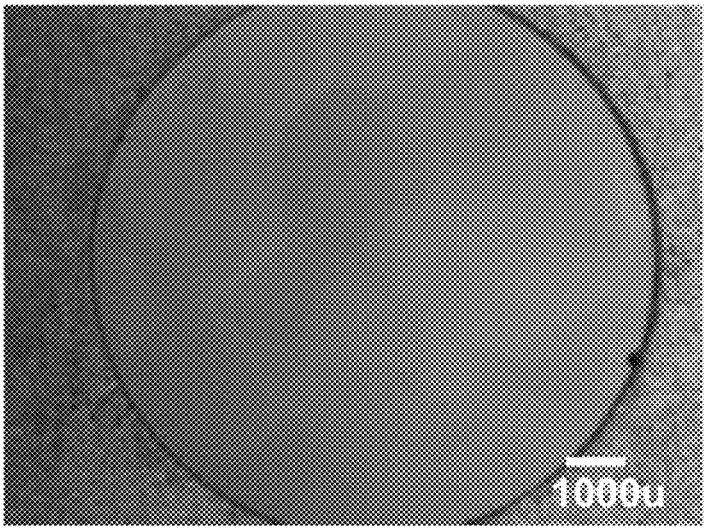
FIG. 4 is an optical microscope photograph showing an example of a cross section of Sample 1.
Figure 5:
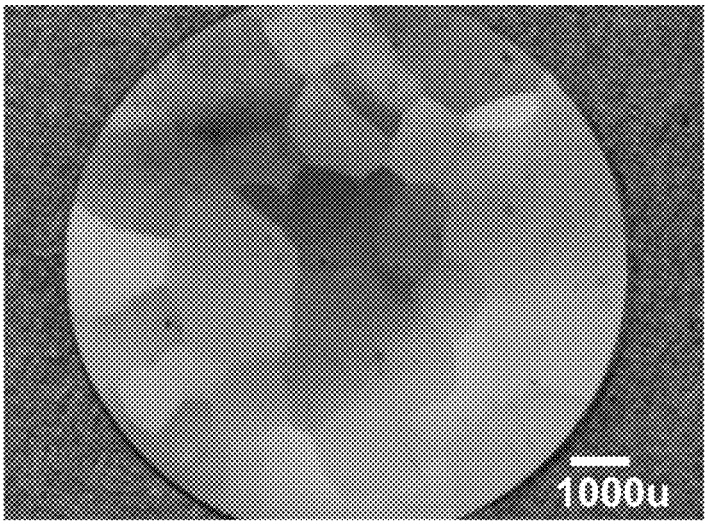
FIG. 5 is an optical microscope photograph showing an example of a cross section of Sample 3.

FIG. 4 shows an example of a cross-sectional photograph of Sample 1. FIG. 5 shows an example of a cross-sectional photograph of Sample 3. The field of view of each of the photographs in FIGS. 4 and 5 is 10 mm, and the scale bar at the lower right is 1000 μm.

Figure 6:
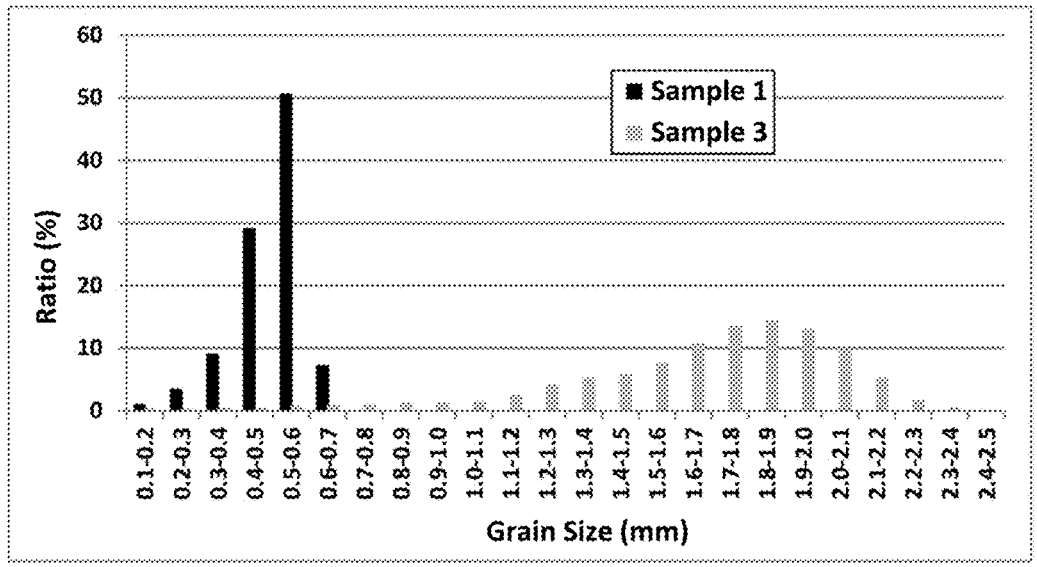
FIG. 6 is a graph for particle size distributions of Sample 1 and Sample 3.

FIG. 6 shows a graph for the grain size distribution. The horizontal axis of the graph in FIG. 6 represents a grain size (mm), and the vertical axis represents a ratio (% by number) of the corresponding grain size.

As shown in the graph of FIG. 6, the grain size of Sample 1 was lower and the uniformity was higher than those of Sample 3. The same measurement was carried out for Sample 2, showing the same tendency of the distribution as that of Sample 3.

The average crystal grain size D50 calculated from the above measured values was 0.512 mm for Sample 1, and 1.764 mm for Sample 3. The average crystal grain size D90 was 0.595 mm for Sample 1, and 2.068 mm for Sample 3.

Further, the average crystal grain size D50 was obtained for Samples 2 and 4 to 6 as well. As a result, the average crystal size D50 was 1.58 mm for Sample 2, 0.554 mm for Sample 4, 0.611 mm for Sample 5, and 0.508 mm for Sample 6. The average crystal grain size D90 was 1.912 mm for Sample 2, 0.622 mm for Sample 4, 0.724 mm for Sample 5, and 0.565 mm for Sample 6.

[Area Ratio of β Phases]

Samples 1 to 6 were observed by an optical microscope. The observation was carried out by polishing each sample to #2000 with abrasive paper, and then buffing it, and observing it with an optical microscope (Nikon ECLIPSEMA) at magnifications of 200, 100, and 400. A photograph was taken from microscopic observation, the color tone of the resulting photograph was divided into 256 stages, and 65 to 168 stages were determined to be the β phases.

Based on the microscopic observation, the number of β phases per a plane having 5 mm×5 mm was counted at 10 points, and its average value was calculated. For counting, the number of β phases was visually counted for 2 points per each sample, and a binarization threshold value (65 in 256 steps) was determined from the result so as to match the visual count. For the remaining 8 points, the number of β phases was counted by image processing based on that binarization threshold value.

For Sample 3, the number of β phases per 5 mm×5 mm was 100 or more, and the presence of larger β phases each having a diameter of 100 μm or more was observed. The area ratio of the β phases was 14.9%.

For Sample 1, the number of a phases and γ phases per 5 mm×5 mm was zero in the observation range. Therefore, the area ratio of the α phases was 0%, and the area ratio of the γ phases was 0%. As a result in this case, the area ratio of the β phases was calculated to be 100%.

For Sample 2, the number of β phases per 5 mm×5 mm was 100 or more, and the presence of larger β phases each having a diameter of 100 μm or more was observed. The area ratio of the β phases was 13.1%.

For Sample 4, the number of a phases and γ phases per 5 mm×5 mm was zero in the observation range. Therefore, the area ratio of the α phases was 0%, and the area ratio of the γ phases was 0%. As a result in this case, the area ratio of the β phases was calculated to be 100%.

For sample 5, the number of a phases and γ phases per 5 mm×5 mm was zero in the observation range. Therefore, the area ratio of the α phases was 0%, and the area ratio of the γ phases was 0%. As a result in this case, the area ratio of the β phases was calculated to be 100%.

For sample 6, the number of a phases and γ phases per 5 mm×5 mm was zero in the observation range. Therefore, the area ratio of the α phases was 0%, and the area ratio of the γ phases was 0%. As a result in this case, the area ratio of the β phases was calculated to be 100%.

INDUSTRIAL APPLICABILITY

The present invention provides a corrosion-resistant CuZn alloy. The present invention is an industrially useful invention.

The invention claimed is:

1. A CuZn alloy, the CuZn alloy having a Zn content of from 36.8 to 56.5% by mass, the balance being Cu and inevitable impurities, wherein the CuZn alloy has an area ratio of β phases of 99.9% or more, wherein the total content of Zn and Cu is 99.999% by mass or more.

2. The CuZn alloy according to claim 1, wherein the CuZn alloy has a total area ratio of α phases and γ phases of 0.01% or less.

3. The CuZn alloy according to claim 1, wherein the CuZn alloy is an alloy for electrodes.

4. The CuZn alloy according to claim 1, wherein the CuZn alloy has a Na content of less than 0.05 ppm, a Mg content of less than 0.01 ppm, an Al content of less than 0.01 ppm, a Si content of less than 0.5 ppm, a P content of less than 0.01 ppm, a S content of less than 0.05 ppm, a Cl content of less than 0.05 ppm, a K content of less than 0.01 ppm, a V content of less than 0.1 ppm, a Cr content of less than 1 ppm, a Mn content of less than 0.5 ppm, a Fe content of less than 1 ppm, a Ni content of less than 5 ppm, a Ga content of less than 0.1 ppm, an As content of less than 0.05 ppm, a Se content of less than 0.1 ppm, a Mo content of less than 0.5 ppm, a Ag content of less than 0.5 ppm, a Cd content of less than 0.5 ppm, a Sn content of less than 0.1 ppm, an Sb content of less than 0.01 ppm, a Ba content of less than 0.01 ppm, a Pb content of less than 5 ppm, a Bi content of less than 0.01 ppm, and an O content of less than 10 ppm.

* * * * *